US006767371B2

(12) United States Patent
Ferguson et al.

(10) Patent No.: US 6,767,371 B2
(45) Date of Patent: Jul. 27, 2004

(54) DETERGENT COMPOSITION

(75) Inventors: Paul Ferguson, Bebington (GB); Dax Kukulj, Kingston (AU)

(73) Assignee: Unilever Home & Personal Care USA division of Conopco, Inc., Greenwich, CT (US)

( * ) Notice: Subject to any disclaimer, the term of this patent is extended or adjusted under 35 U.S.C. 154(b) by 25 days.

(21) Appl. No.: 10/144,998

(22) Filed: May 14, 2002

(65) Prior Publication Data

US 2003/0017961 A1 Jan. 23, 2003

(30) Foreign Application Priority Data

May 15, 2001 (EP) ..... 01304322

(51) Int. Cl.[7] ..... D06M 15/00; C11D 3/37; C11D 3/50

(52) U.S. Cl. ..... 8/115.51; 8/115.6; 8/115.56; 8/133; 510/101; 510/278; 510/475

(58) Field of Search ..... 510/101, 278, 510/475; 8/115.51, 115.6, 115.56, 133

(56) References Cited

U.S. PATENT DOCUMENTS 6,596,034 B1 * 7/2003 Crawford et al. ..... 8/115.6

2003/0017961 A1 * 1/2003 Ferguson et al ..... 510/475

FOREIGN PATENT DOCUMENTS

| | | | | |
|---|---|---|---|---|
| GB | 1062422 | | 3/1967 | |
| JP | 03249270 | A | 11/1991 | |
| JP | 03249270 | * | 11/1991 | ..... D06M/13/02 |
| JP | 4180798 | A | 6/1992 | |
| WO | 96/15309 | | 5/1996 | |
| WO | 96/15310 | | 5/1996 | |
| WO | 01/38627 | | 5/2001 | |
| WO | WO 01/38627 | * | 5/2001 | |

OTHER PUBLICATIONS

PCT Int'l. Search Report No. PCT/EP 02/05097, mailed Sep. 30, 2002, 4 pp.

European Search Report No., EP 01 30 4322, dated Oct. 22, 2001, 2 pp.

Abstract and translation of JP 4180798 A—XP–002213553—1 p. Jun. 26, 1992.

Abstract of JP 3249270 A—XP–002180844—1p. Nov. 7, 1991.

*Journal of Applied Polymer Science*, Rawls et al., vol. 5, 341–349 (1971). No Month Given.

* cited by examiner

*Primary Examiner*—Brian P. Mruk
(74) *Attorney, Agent, or Firm*—Alan A. Bornstein

(57) ABSTRACT

A fabric care composition comprising a thermoplastic elastomer and a terpene.

12 Claims, No Drawings

DETERGENT COMPOSITION

This invention relates to textile material, to methods of treating fabric in order to obtain the textile material, to the use of thermoplastic elastomers for improving the crease recovery properties and/or elasticity of a fabric and to fabric care compositions, which comprise a thermoplastic elastomer.

The creasing of fabrics is an almost inevitable consequence of cleaning fabrics, such as in a domestic laundering process. Fabrics also become creased in wear. Creasing can be a particular problem for fabrics, which contain cellulosic fibres such as cotton, because the creasing is often difficult to remove. Generally, the creases, which are developed in a fabric during laundering, are removed by ironing. However, because ironing is seen as a time consuming chore, there is an increasing trend for fabrics to be designed such that the need for ironing is reduced and/or the effort required for ironing is lower.

Compositions for reducing the wrinkling of fabric are described in WO 96/15309 and WO 96/15310. The compositions contain a silicone and a film-forming polymer and it appears that it is the lubricating effect of the silicone, which is responsible for their anti-wrinkle properties. This conclusion is supported by the fact that a wide variety of polymers is mentioned as being suitable for use in the compositions.

Industrial treatments of fabrics to reduce their tendency to crease are known. JP-A-04-50234 describes a textile treatment in which the crease resistance of a plain weave cotton fabric is increased by applying a so-called "shape memory resin" to the fabric. However, this document teaches that the resin is applied to the fabric at a relatively high amount of 10% by weight on weight of fabric and it is not clear how this level of resin affects other properties of the fabric. Furthermore, treatment of the fabric with the resins is followed by a step of drying at 80° C. and the shape memory function is described as being heat-sensitive, with deformations at normal temperatures being restored to the original shape on heating at a specific temperature.

A relationship between polymer elastic properties and the ability to impart improved wrinkle recovery to cotton fabric is described by Rawls et al in Journal of Applied Polymer Science, vol. 15, pages 341–349 (1971). A variety of different elastomers was applied to fabric and, particularly in the few cases where thermoplastic elastomers were used, the polymers were applied to the fabric at the relatively high levels of 4% and above. There is no indication that any benefit would be obtained in applying polymers to the fabric at lower levels and no suggestion as to practical applications of the technique.

The treatment of fabrics with cross-linking agents in order to impart antiwrinkle properties is known. Compounds such as formaldehyde-based polymers, DMDHEU (dimethylol dihydroxy ethylene urea) and BTCA (butyl-1, 2,3,4-tetracarboxylic acid) may be used as the cross-linking agent. However, these treatments have the disadvantage of reducing the tensile strength of the fabrics.

Our co-pending application GB 9927903.6 describes the use of thermoplastic elastomers on fabric and in fabric care compositons.

The present invention aims to reduce the tendency for fabrics to become wrinkled or creased.

The invention further aims to reduce the deleterious effects on elasticity and tensile strength of fabrics, which some conventional anti-wrinkle treatments impart. The invention may also provide a degree of shape retention in the fabric.

According to the present invention, there is provided a fabric care composition comprising a thermoplastic elastomer and a terpene.

In another aspect of the invention is provided a process for treating fabric in which the fabric is coated with the composition in the paragraph above.

Also provided by the invention is the use of a composition fabric care composition comprising a thermoplastic elastomer and a terpene, to improve the crease recovery properties and/or elasticity and/or tensile strength of a fabric.

Preferably, the textile material used in the invention is suitable for use in a garment or is part or all of a garment itself. The fabric may be woven or knitted (both of which terms are intended to be covered by the generic term "textile material", as used herein) and preferably comprises a cellulosic fibre, such as cotton eg, in an amount of 50% to 100%, such as 75% to 100% for example. If the fabric contains less than 100% cellulosic fibres, the balance may be of any natural or synthetic fibres or a mixture thereof, such as polyamide or polyester, for example.

The polymer composition comprises a thermoplastic elastomer. The composition may contain other components, for example other polymers which impart benefits to the fabric when it is used in a garment. The composition may be substantially free of lubricating polymers such as silicones.

The thermoplastic elastomer is desirably non-crosslinked and is preferably a block copolymer. The elastomer can be linear, branched, and radial or star shaped in topology but is preferably linear. More preferably, the elastomer comprises at least two hard blocks linked by one soft block (eg, an ABA block copolymer). The hard blocks are of a material that, on its own (i.e., as a single polymer), is hard at room temperature but becomes fluid on heating. The soft blocks comprise a softer material that, on its own, is rubber-like at room temperature. Preferably, the percentage by weight of the hard blocks in the polymer is from 2 to 98%, more preferably from 5 to 95%, most preferably from 10 to 90%.

Conveniently, the polymers have a molecular weight of from 1,000 to 2,000,000, preferably from 2,000 to 1,000,000 and most preferably from 3,000 to 500,000.

The hard blocks of the thermoplastic elastomer preferably comprise aromatic rings, optionally substituted. Thus, the hard blocks may be, for example, polymers or copolymers of styrene or of derivatives of styrene. Alternative hard blocks include, for example, polymers and copolymers comprising poly(methyl methacrylate).

The soft blocks are conveniently polymers or copolymers of branched or unbranched $C_2$ to $C_6$ alkenes, $C_4$ to $C_8$ alkadienes, $C_2$ to $C_6$ alkylene diols or $C_2$ to $C_8$ alkylene oxides. Preferably, the soft blocks are polymers or copolymers of ethene, propene, butane, butadiene (cis or trans) or isoprene (cis or trans). If the soft block is a polymer or copolymer of butadiene or isoprene, the butadiene or isoprene residues may be fully or partially hydrogenated.

Suitable thermoplastic elastomers include block copolymers of styrene-isoprene-styrene; styrene-butadiene-styrene, styrene-ethylene/butadiene-styrene, styrene-ethylene-styrene, styrene-ethylene/propylene-styrene, styrene-propylene-styrene and styrene-butylene-styrene and block polymers selected from polyurethane's, polyesters, polyamides and polypropylene/ethylene-propylene.

In the present invention, the thermoplastic elastomer is preferably applied to the fabric such that from 0.01% to 2% by weight on weight of fabric of the thermoplastic elastomer is coated onto the fabric. Advantageously, lower levels of thermoplastic elastomer can be applied eg, from 0.01% to 1.5% preferably 0.01% to 1%, more preferably 0.1% to 1%.

Generally, the thermoplastic elastomer will at least partially coat individual fibres. At these levels of application, the physical properties of the fabric which make it suitable for use in a garment are retained (ie, the overall feel and appearance of the fabric remains substantially unchanged) but, unexpectedly, the fabric has improved crease recovery properties.

The crease recovery properties of a fabric treated according to the present invention are improved relative to fabric not so treated. Treatment of the fabric typically reduces the tendency of the fabric to remain creased. Thus, following treatment according to the invention, the crease recovery angle, which is a measure of the degree to which a fabric returns to its original shape following creasing, increases. The fabric may still require a degree of treatment (eg, by ironing) to reduce its creasing after washing and drying in a conventional domestic laundering process. However, the amount of crease reduction by ironing required for fabric treated according to the invention will typically be less than that required by untreated fabric. It will be appreciated that any reduction in the amount of crease reduction, such as ironing, which is required, is beneficial.

The terpene is used in the composition to solubilise the thermoplastic polymer. It is preferable if the terpene is cyclic in nature, particularly preferred are (r)-(+)-limonene, (s)-(−) limonene or mixtures thereof.

The process of the invention preferably comprises the step of applying a solution or an emulsion of the thermoplastic elastomer to the fabric. The solution may be applied to the fabric by conventional methods such as dipping, spraying or soaking, for example.

The fabric care composition of the invention preferably comprises a solution, dispersion or emulsion comprising a thermoplastic elastomer and a textile compatible carrier. The textile compatible carrier facilitates contact between the fabric and the thermoplastic elastomer. The textile compatible carrier may be water or a surfactant, however when it is water perfume must be present. In a composition that is used during the washing or rinse cycles of a washing machine, it is highly preferable if the textile compatible carrier is a cationic surfactant, more preferably a cationic softening agent.

If the fabric care composition of the invention is in the form of a dispersion or emulsion of the thermoplastic elastomer or if, in the process of the invention, a dispersion or emulsion of the thermoplastic elastomer is used, the fabric treated with the composition may need to be heated to a temperature above the Tg of the hard blocks of the elastomer in order to obtain the advantages of the invention. The heating of the treated fabric can be carried out as a separate heating step or may form part of the laundering process eg taking place during drying of the fabric (for example in a tumble dryer) or, more preferably, during ironing of the fabric. Alternatively, a plasticiser or coalescing agent may be used to lower the Tg of the thermoplastic elastomer in order to avoid the need for heating or to reduce the temperature of the heating step required to obtain the advantages of the invention.

The process of the invention may be carried out as a treatment of the fabric before or after it has been made into garments, as part of an industrial textile treatment process. Alternatively, it may be provided as a spray composition eg, for domestic (or industrial) application to fabric in a treatment separate from a conventional domestic laundering process.

Alternatively, in the method of the invention, the treatment is carried out as part of a laundering process. Suitable laundering processes include large scale and small-scale (eg domestic) processes. Such a process may involve the use of a fabric care composition of the invention, for example. The fabric care composition of the invention may be a main wash detergent composition, in which case the textile compatible carrier may be a detergent and the composition may contain other additives, which are conventional in main wash detergent compositions. Alternatively, and preferably, the fabric care composition may be adapted for use in the rinse cycle of a domestic laundering process, such as a fabric conditioning composition or an adjunct, and the textile compatible carrier may be a fabric conditioning compound (such as a quaternary alkylammonium compound) or simply water, and conventional additives such as perfume may be present in the composition.

It is advantageous in compositions for use in a domestic setting to further comprise a plasticiser. In the context of this invention on plasticiser is any material that can modify the flow properties of the thermoplastic elastomer. Suitable plasticizers include $C_{12}$–$C_{20}$ alcohols, glycol ethers, phthalates, aromatic hydrocarbons and terpenes. It is also highly advantageous, if the compositions comprise a perfume.

Detergent Active Compounds

The Detergent Composition

The novel detergent components of the present invention may be incorporated in detergent compositions of all physical types, for example, powders, liquids, gels and solid bars.

These compositions will generally contain detergent-active compounds and detergency builders, and may optionally contain bleaching components and other active ingredients to enhance performance and properties.

Detergent-active Compounds

The detergent compositions of the invention will contain, as essential ingredients, one or more detergent-active compounds (surfactants) which may be chosen from soap and non-soap anionic, cationic, nonionic, amphoteric and zwitterionic detergent-active compounds, and mixtures thereof. Many suitable detergent-active compounds are available and are fully described in the literature, for example, in "Surface-Active Agents and Detergents", Volumes I and II, by Schwartz, Perry and Berch.

The preferred detergent-active compounds that can be used are soaps and synthetic non-soap anionic and nonionic compounds.

Anionic surfactants are well-known to those skilled in the art. Examples include alkylbenzene sulphonates, particularly linear alkylbenzene sulphonates having an alkyl chain length of $C_8$–$C_{15}$; primary and secondary alkylsulphates, particularly $C_8$–$C_{15}$ primary alkyl sulphates; alkyl ether sulphates; olefin sulphonates; alkyl xylene sulphonates; dialkyl sulphosuccinates; and fatty acid ester sulphonates. Sodium salts are generally preferred.

Nonionic surfactants that may be used include the primary and secondary alcohol ethoxylates, especially the $C_8$–$C_{20}$ aliphatic alcohols ethoxylated with an average of from 1 to 20 moles of ethylene oxide per mole of alcohol, and more especially the $C_{10}$–$C_{15}$ primary and secondary aliphatic alcohols ethoxylated with an average of from 1 to 10 moles of ethylene oxide per mole of alcohol. Non-ethoxylated nonionic surfactants include alkylpolyglycosides, glycerol monoethers, and polyhydroxyamides (glucamide).

The choice of detergent-active compound (surfactant), and the amount present, will depend on the intended use of the detergent composition. For example, for machine dishwashing a relatively low level of a low-foaming nonionic surfactant is generally preferred. In fabric washing compositions, different surfactant systems may be chosen, as is well known to the skilled formulator, for handwashing products and for products intended for use in different types of washing machine.

The total amount of surfactant present will also depend on the intended end use and may be as low as 0.5 wt %, for example, in a machine dishwashing composition, or as high as 60 wt %, for example, in a composition for washing fabrics by hand. In compositions for machine washing of fabrics, an amount of from 5 to 40 wt % is generally appropriate.

Detergent compositions suitable for use in most automatic fabric washing machines generally contain anionic non-soap surfactant, or nonionic surfactant, or combinations of the two in any ratio, optionally together with soap.

Detergency Builders

The detergent compositions of the invention will generally also contain one or more detergency builders. The total amount of detergency builder in the compositions will suitably range from 5 to 80 wt %, preferably from 10 to 60 wt %.

Inorganic builders that may be present include sodium carbonate, if desired in combination with a crystallisation seed for calcium carbonate, as disclosed in GB 1 437 950 (Unilever); crystalline and amorphous aluminosilicates, for example, zeolites as disclosed in GB 1 473 201 (Henkel), amorphous aluminosilicates as disclosed in GB 1 473 202 (Henkel) and mixed crystalline/amorphous aluminosilicates as disclosed in GB 1 470 250 (Procter & Gamble); and layered silicates as disclosed in EP 164 514B (Hoechst). Inorganic phosphate builders, for example, sodium orthophosphate, pyrophosphate and tripolyphosphate, may also be present, but on environmental grounds those are no longer preferred.

The detergent compositions of the invention preferably contain an alkali metal, preferably sodium, aluminosilicate builder. Sodium aluminosilicates may generally be incorporated in amounts of from 10 to 70% by weight (anhydrous basis), preferably from 25 to 50 wt %.

The alkali metal aluminosilicate may be either crystalline or amorphous or mixtures thereof, having the general formula:

$$0.8\text{–}1.5\ Na_2O.Al_2O_3.0.8\text{–}6\ SiO_2$$

These materials contain some bound water and are required to have a calcium ion exchange capacity of at least 50 mg CaO/g. The preferred sodium aluminosilicates contain 1.5–3.5 $SiO_2$ units (in the formula above). Both the amorphous and the crystalline materials can be prepared readily by reaction between sodium silicate and sodium aluminate, as amply described in the literature.

Suitable crystalline sodium aluminosilicate ion-exchange detergency builders are described, for example, in GB 1 429 143 (Procter & Gamble). The preferred sodium aluminosilicates of this type are the well-known commercially available zeolites A and X, and mixtures thereof.

The zeolite may be the commercially available zeolite 4A now widely used in laundry detergent powders. However, according to a preferred embodiment of the invention, the zeolite builder incorporated in the compositions of the invention is maximum aluminium zeolite P (zeolite MAP) as described and claimed in EP 384 070A (Unilever). Zeolite MAP is defined as an alkali metal aluminosilicate of the zeolite P type having a silicon to aluminium ratio not exceeding 1.33, preferably within the range of from 0.90 to 1.33, and more preferably within the range of from 0.90 to 1.20.

Especially preferred is zeolite MAP having a silicon to aluminium ratio not exceeding 1.07, more preferably about 1.00. The calcium binding capacity of zeolite MAP is generally at least 150 mg CaO per g of anhydrous material.

Organic builders that may be present include polycarboxylate polymers such as polyacrylates, acrylic/maleic copolymers, and acrylic phosphinates; monomeric polycarboxylates such as citrates, gluconates, oxydisuccinates, glycerol mono-, di- and trisuccinates, carboxymethyloxysuccinates, carboxymethyloxymalonates, dipicolinates, hydroxyethyliminodiacetates, alkyl- and alkenylmalonates and succinates; and sulphonated fatty acid salts. This list is not intended to be exhaustive.

Especially preferred organic builders are citrates, suitably used in amounts of from 5 to 30 wt %, preferably from 10 to 25 wt %; and acrylic polymers, more especially acrylic/maleic copolymers, suitably used in amounts of from 0.5 to 15 wt %, preferably from 1 to 10 wt %.

Builders, both inorganic and organic, are preferably present in alkali metal salt, especially sodium salt, form.

Bleach Components

Detergent compositions according to the invention may also suitably contain a bleach system. Machine dishwashing compositions may suitably contain a chlorine bleach system, while fabric washing compositions may more desirably contain peroxy bleach compounds, for example, inorganic persalts or organic peroxyacids, capable of yielding hydrogen peroxide in aqueous solution.

Suitable peroxy bleach compounds include organic peroxides such as urea peroxide, and inorganic persalts such as the alkali metal perborates, percarbonates, perphosphates, persilicates and persulphates. Preferred inorganic persalts are sodium perborate monohydrate and tetrahydrate, and sodium percarbonate.

Especially preferred is sodium percarbonate having a protective coating against destabilisation by moisture. Sodium percarbonate having a protective coating comprising sodium metaborate and sodium silicate is disclosed in GB 2 123 044B (Kao).

The peroxy bleach compound is suitably present in an amount of from 5 to 35 wt %, preferably from 10 to 25 wt %.

The peroxy bleach compound may be used in conjunction with a bleach activator (bleach precursor) to improve bleaching action at low wash temperatures. The bleach precursor is suitably present in an amount of from 1 to 8 wt %, preferably from 2 to 5 wt %.

Preferred bleach precursors are peroxycarboxylic acid precursors, more especially peracetic acid precursors and peroxybenzoic acid precursors; and peroxycarbonic acid precursors. An especially preferred bleach precursor suitable or use in the present invention is N,N,N',N'-tetracetyl ethylenediamine (TAED). The novel quaternary ammonium and phosphonium bleach precursors disclosed in U.S. Pat. Nos. 4,751,015 and 4,818,426 (Lever Brothers Company) and EP 402 971A (Unilever) are also of great interest. Especially preferred are peroxycarbonic acid precursors, in particular cholyl-4-sulphophenyl carbonate. Also of interest are peroxybenzoic acid precursors, in particular, N,N,N-trimethylammonium toluoyloxy benzene sulphonate; and the cationic bleach precursors disclosed in EP 284 292A and EP 303 520A (Kao).

A bleach stabiliser (heavy metal sequestrant) may also be present. Suitable bleach stabilisers include ethylenediamine tetraacetate (EDTA) and the polyphosphonates such as Dequest (Trade Mark), EDTMP.

An especially preferred bleach system comprises a peroxy bleach compound (preferably sodium percarbonate optionally together with a bleach activator), and a transition metal bleach catalyst as described and claimed in EP 458 397A, EP 458 398A and EP 509 787A (Unilever).

Other Ingredients

The compositions of the invention may contain alkali metal, preferably sodium, carbonate, in order to increase detergency and ease processing. Sodium carbonate may suitably be present in amounts ranging from 1 to 60 wt %, preferably from 2 to 40 wt %. However, compositions containing little or no sodium carbonate are also within the scope of the invention.

Powder flow may be improved by the incorporation of a small amount of a powder structurant, for example, a fatty acid (or fatty acid soap), a sugar, an acrylate or acrylate/maleate polymer, or sodium silicate.

One preferred powder structurant is fatty acid soap, suitably present in an amount of from 1 to 5 wt %.

Other materials that may be present in detergent compositions of the invention include sodium silicate; antiredeposition agents such as cellulosic polymers; fluorescers; inorganic salts such as sodium sulphate; lather control agents or lather boosters as appropriate; proteolytic and lipolytic enzymes; dyes; coloured speckles; perfumes; foam controllers; and fabric softening compounds. This list is not intended to be exhaustive.

Detergent compositions of the invention may be prepared by any suitable method.

Fabric Softening and/or Conditioner Compounds

If the fabric care composition of the present invention is in the form of a fabric conditioner composition, the textile-compatible carrier will be a fabric softening and/or conditioning compound (hereinafter referred to as "fabric softening compound"), which may be a cationic or nonionic compound.

The softening and/or conditioning compounds may be water insoluble quaternary ammonium compounds. The compounds may be present in amounts of up to 8% by weight (based on the total amount of the composition) in which case the compositions are considered dilute, or at levels from 8% to about 50% by weight, in which case the compositions are considered concentrates.

Compositions suitable for delivery during the rinse cycle may also be delivered to the fabric in the tumble dryer if used in a suitable form. Thus, another product form is a composition (for example, a paste) suitable for coating onto, and delivery from, a substrate e.g. a flexible sheet or sponge or a suitable dispenser during a tumble dryer cycle.

Suitable cationic fabric softening compounds are substantially water-insoluble quaternary ammonium materials comprising a single alkyl or alkenyl long chain having an average chain length greater than or equal to $C_{20}$ or, more preferably, compounds comprising a polar head group and two alkyl or alkenyl chains having an average chain length greater than or equal to $C_{14}$. Preferably the fabric softening compounds have two long chain alkyl or alkenyl chains each having an average chain length greater than or equal to $C_{16}$. Most preferably at least 50% of the long chain alkyl or alkenyl groups have a chain length of $C_{18}$ or above. It is preferred if the long chain alkyl or alkenyl groups of the fabric-softening compound are predominantly linear.

Quaternary ammonium compounds having two long-chain aliphatic groups, for example, distearyldimethyl ammonium chloride and di(hardened tallow alkyl) dimethyl ammonium chloride, are widely used in commercially available rinse conditioner compositions. Other examples of these cationic compounds are to be found in "Surface-Active Agents and Detergents", Volumes I and II, by Schwartz, Perry and Berch. Any of the conventional types of such compounds may be used in the compositions of the present invention.

The fabric softening compounds are preferably compounds that provide excellent softening, and are characterised by a chain melting Lβ to Lα transition temperature greater than 25° C., preferably greater than 35° C., most preferably greater than 45° C. This Lβ to Lα transition can be measured by DSC as defined in "Handbook of Lipid Bilayers", D Marsh, CRC Press, Boca Raton, Fla., 1990 (pages 137 and 337).

Substantially water-insoluble fabric softening compounds are defined as fabric softening compounds having a solubility of less than $1\times10^{-3}$ wt % in demineralised water at 20° C. Preferably the fabric softening compounds have a solubility of less than $1\times10^{-4}$ wt %, more preferably less than $1\times10^{-8}$ to $1\times10^{-6}$ wt %.

Especially preferred are cationic fabric softening compounds that are water-insoluble quaternary ammonium materials having two $C_{12}$–$C_{22}$ alkyl or alkenyl groups connected to the molecule via at least one ester link, preferably two ester links. An especially preferred ester-linked quaternary ammonium material can be represented by the formula II:

(II)

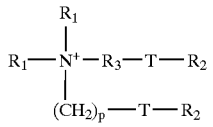

wherein each $R_1$ group is independently selected from $C_{1-4}$ alkyl or hydroxyalkyl groups or $C_{2-4}$ alkenyl groups; each $R_2$ group is independently selected from $C_{8-28}$ alkyl or alkenyl groups; and wherein $R_3$ is a linear or branched alkylene group of 1 to 5 carbon atoms, T is

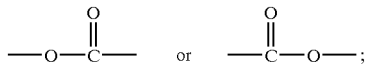

and p is 0 or is an integer from 1 to 5.

Di(tallowoxyloxyethyl) dimethyl ammonium chloride and/or its hardened tallow analogue is especially preferred of the compounds of formula (II).

A second preferred type of quaternary ammonium material can be represented by the formula (III):

(III)

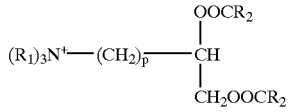

wherein $R_1$, p and $R_2$ are as defined above.

It is advantageous if the quaternary ammonium material is biologically biodegradable.

Preferred materials of this class such as 1,2-bis(hardened tallowoyloxy)-3-trimethylammonium propane chloride and their methods of preparation are, for example, described in U.S. Pat. No. 4,137,180 (Lever Brothers Co). Preferably these materials comprise small amounts of the corresponding monoester as described in U.S. Pat. No. 4,137,180, for example, 1-hardened tallowoyloxy-2-hydroxy-3-trimethylammonium propane chloride.

Other useful cationic softening agents are alkyl pyridinium salts and substituted imidazoline species. Also useful are primary, secondary and tertiary amines and the condensation products of fatty acids with alkylpolyamines.

The compositions may alternatively or additionally contain water-soluble cationic fabric softeners, as described in GB 2 039 556B (Unilever).

The compositions may comprise a cationic fabric softening compound and an oil, for example as disclosed in EP-A-0829531.

The compositions may alternatively or additionally contain nonionic fabric softening agents such as lanolin and derivatives thereof.

Lecithins are also suitable softening compounds.

Nonionic softeners include Lβ phase forming sugar esters (as described in M Hato et al Langmuir 12, 1659, 1666, (1996)) and related materials such as glycerol monostearate or sorbitan esters. Often these materials are used in conjunction with cationic materials to assist deposition (see, for example, GB 2 202 244). Silicones are used in a similar way as a co-softener with a cationic softener in rinse treatments (see, for example, GB 1 549 180).

The compositions may also suitably contain a nonionic stabilising agent. Suitable nonionic stabilising agents are linear $C_8$ to $C_{22}$ alcohols alkoxylated with 10 to 20 moles of alkylene oxide, $C_{10}$ to $C_{20}$ alcohols, or mixtures thereof.

Advantageously the nonionic stabilising agent is a linear $C_8$ to $C_{22}$ alcohol alkoxylated with 10 to 20 moles of alkylene oxide. Preferably, the level of nonionic stabiliser is within the range from 0.1 to 10% by weight, more preferably from 0.5 to 5% by weight, most preferably from 1 to 4% by weight. The mole ratio of the quaternary ammonium compound and/or other cationic softening agent to the nonionic stabilising agent is suitably within the range from 40:1 to about 1:1, preferably within the range from 18:1 to about 3:1.

The composition can also contain fatty acids, for example $C_8$ to $C_{24}$ alkyl or alkenyl monocarboxylic acids or polymers thereof. Preferably saturated fatty acids are used, in particular, hardened tallow $C_{16}$ to $C_{18}$ fatty acids. Preferably the fatty acid is non-saponified, more preferably the fatty acid is free, for example oleic acid, lauric acid or tallow fatty acid. The level of fatty acid material is preferably more than 0.1% by weight, more preferably more than 0.2% by weight. Concentrated compositions may comprise from 0.5 to 20% by weight of fatty acid, more preferably 1% to 10% by weight. The weight ratio of quaternary ammonium material or other cationic softening agent to fatty acid material is preferably from 10:1 to 1:10.

The fabric conditioning compositions may include silicones, such as predominately linear polydialkylsiloxanes, e.g. polydimethylsiloxanes or aminosilicones containing amine-functionalised side chains; soil release polymers such as block copolymers of polyethylene oxide and terephthalate; amphoteric surfactants; smectite type inorganic clays; zwitterionic quaternary ammonium compounds; and nonionic surfactants.

The fabric conditioning compositions may also include an agent, which produces a pearlescent appearance, e.g. an organic pearlising compound such as ethylene glycol distearate, or inorganic pearlising pigments such as microfine mica or titanium dioxide ($TiO_2$) coated mica.

The fabric conditioning compositions may be in the form of emulsions or emulsion precursors thereof.

Other optional ingredients include emulsifiers, electrolytes (for example, sodium chloride or calcium chloride) preferably in the range from 0.01 to 5% by weight, pH buffering agents, and perfumes (preferably from 0.1 to 5% by weight).

Further optional ingredients include non-aqueous solvents, perfume carriers, fluorescers, colourants, hydrotropes, antifoaming agents, antiredeposition agents, enzymes, optical brightening agents, opacifiers, dye transfer inhibitors, anti-shrinking agents, anti-wrinkle agents, anti-spotting agents, germicides, fungicides, anti-oxidants, UV absorbers (sunscreens), heavy metal sequestrants, chlorine scavengers, dye fixatives, anti-corrosion agents, drape imparting agents, antistatic agents and ironing aids. This list is not intended to be exhaustive.

Fabric Treatment Products

The fabric care composition of the invention may be in the form of a liquid, solid (e.g. powder or tablet), a gel or paste, spray, stick or a Loam or mousse. Examples including a soaking product, a rinse treatment (e.g. Conditioner or finisher) or a mainwash product. The composition may also be applied to a substrate e.g. a flexible sheet or used in a dispenser which can be used in the wash cycle, rinse cycle or during the dryer cycle.

The present invention has the advantage not only of increasing the crease recovery angle of fabric but also of improving the tensile strength of the fabric. The tensile strength of fabrics has in the past been increased by, for example, including fibres of a thermoplastic elastomer, such as Lycra (trade mark) yarns, in the fabric itself. It was unexpected that coating the fibres with a thermoplastic elastomer, according to the invention, could provide improved crease resistance and increased tensile strength. The effect was particularly surprising because a number of conventional treatments for improving the crease resistance of fabrics can have the opposite effect of reducing the tensile strength of the fabric, particularly where the treatment involves cross-linking of the fabric.

It is preferable if after application compositions according to the invention a curing process takes place such as ironing or tumble drying.

The invention will now be illustrated by the following non-limiting Examples.

Experimental Procedure:

Polystyrene-block-polybutadiene-block-polystyrene is referred to as PSBS.

Polystyrene-block-poly(ethylene-random-butylene)-block-polystyrene is referred to as PSEBS.

Each polymer (PSBS or PSEBS) was dissolved in D-Limonene to give the desired polymer solution concentration. Prewashed cotton sheeting was weighed and soaked in the polymer solution. The cotton sheets were removed and the excess solvent was removed by compression through a set of rollers (Mathis Padder, pressure=60, speed=2.5 m/min, 'pick up' ~100%), weighed and then air dried at ambient temperature. From the weight of the fabric before and dipping into the solution and the solution concentration it is possible to calculate the percentage of polymer on the fabric. The dried sheets were ironed flat and conditioned at 65% relative humidity and 20° C. for at least 24 hours.

The hystersis, modulus, maximum and minimum extension were determined using a Instron Testometric (trade mark) tester:

| | |
|---|---|
| Sample size: | 150 mm × 50 mm |
| Clamp width: | 25 mm |
| Stretch area: | 100 mm × 25 mm |
| Elongation rate: | 100 mm/min |
| Extension Cycle: | Begin at rest with 0 kg force<br>Extend until 0.2 kg force is attained<br>Return to 0 kg force |

The percentage immediate recovery was also determined using an Instron Testometric using the Ball Bursting strength attachment as detailed in ASTM D3787-89:

| | |
|---|---|
| Sample size: | 400 mm × 80 mm |
| Jaws: | Ball burst device |
| Load cell: | 5 kgf |
| Mode: | Compression |
| Cycle: | Begin at 2 gf |
| | Compressed to 50 gf |
| | Repeated 5 times; on last cycle held at 50 gf for 120 seconds |
| | Released to 2 gf and held for 2 seconds |
| | Ball released from fabric for 60 seconds |
| | Compressed to 2 gf |
| | Returned to start position |

The crease recovery angle was measured using a "Shirley crease recovery angle tester" based on AATCC Test Method 66-1990. 50 mm×25 mm samples were prepared, folded in half and placed under a 1 kg load for 60 seconds. The angle that the sample opened up to after 60 seconds was measured. Six measurements were performed in the warp direction on the fabric and averaged. The crease recovery angle was determined from the sum of the average warp values.

EXAMPLES 1–9

Testometric on Woven Cotton

The effect of the treatments on woven cotton on hysteresis and residual extension were evaluated using a Testometric tester. The results are shown in the following table:

| Example | Treatment | Percentage on weight of fabric (% owf) | Hysteresis Area | Residual Extension (%) |
|---|---|---|---|---|
| A | D-Limonene Control | | 0.50 | 3.12 |
| 1 | PSBS in D-Limonene | 0.5 | 0.49 | 1.56 |
| 2 | PSBS in D-Limonene | 2 | 0.25 | 0.69 |
| 3 | PSEBS in D-Limonene | 2 | 0.28 | 1.08 |
| 4 | PSBS in D-Limonene | 5 | 0.09 | 0.385 |
| 5 | PSBS in L-Limonene | 5 | 0.05 | 0.355 |
| 6 | PSBS in Dipentene | 5 | 0.25 | 0.985 |

The polymer treatments give reduced hystersis area and lower % residual extension compared to the control, which leads to reduced 'in-wear' wrinkling and improved shape retention. The effect is dose dependent and increases with increasing level on fabric. Unsaturated PSEBS performs similar to PSES.

EXAMPLES 7–10

Bagging Test

The effect of the treatments on the degree to which knitted fabric returns to its original state after being subjected to a deformation (i.e. % immediate recovery) were evaluated using a Testometric tester. The results are shown in the following table:

| Example | Treatment | Percentage on weight of fabric (% owf) | % Immediate Recovery |
|---|---|---|---|
| B | D-Limonene Control | | 25.836 |
| 7 | PSBS in D-Limonene | 0.5 | 53.493 |
| 8 | PSBS in D-Limonene | 2 | 47.884 |
| 9 | PSBS in D-Limonene | 5 | 50.004 |
| 10 | PSBS in Dipentene | 5 | 54.307 |

All polymer treated knits give increased percentage immediate recovery after being deformed compared to control.

EXAMPLES 11–14

Crease Recovery Angle

The effect of the treatments on crease recovery angle were evaluated using a Shirley crease recovery angle tester. The results are shown in the following table

| Example | Treatment | Percentage on weight of fabric (% owf) | Crease Recovery Angle (°) |
|---|---|---|---|
| C | D-Limonene Control | | 67.4 |
| 11 | PSBS in D-Limonene | 0.5 | 85.4 |
| 12 | PSBS in D-Limonene | 2 | 101.6 |
| 13 | PSBS in D-Limonene | 5 | 121.8 |
| 14 | PSBS in L-Limonene | 5 | 120.2 |

The polymer treated samples give greater crease recovery angle prepared to control.

EXAMPLE 15

PSBS Dispersed in Water

PSBS (0.5 g) was dissolved in D-Limonene (9.5 g). Sodium dodecyl sulphate (0.125 g) was dissolved in water (9.375 g) and 2–3 drops of Silicone silicone anti-foam were added. The two solutions were mixed together to give a 2 phase system. The mixture was ultra-sounded (Branson Sonifier) for 5 minutes using a small screw head probe at output power #10 on the cycle mode (#20). A white emulsion was formed which was filtered through 125 micron mesh and no coagulum was obtained. The particle size of the emulsion was determined using a Malvern Zetasizer and found to be 330 nm. Final polymer solids were 5% (w/w).

The dispersion was diluted to give 2% w/w solution. Woven cotton sheeting was soaked in the polymer solution. The cotton sheets were removed and the excess solvent was removed by compression through a set of rollers (Mathis Padder, pressure=60, speed=2.5 m/min, 'pick up' ~100%), weighed and then air dried at ambient temperature. The resultant level of polymer on the fabric was 2.2%.

EXAMPLE 16

Spray Application

PSBS was dissolved in D-Limonene to give a 2% w/w solution. The solution was applied to the fabric via a spray bottle (polyethylene trigger operated spray bottle from Fisher Scientific Ltd). The spray bottle was held about 10 cm from the cotton sheeting whilst spraying and the cotton sheeting was left to dry. The resultant level of polymer on the fabric was 2.3%.

What is claimed is:

1. A fabric care composition comprising a thermoplastic elastomer and a terpene wherein the thermoplastic elastomer is a non-crosslinked block copolymer, comprising at least two hard blocks linked by one soft block.

2. The fabric care composition of claim 1 in which the terpene is (r)-(+)limonene, (s)-(−)limonene or mixtures thereof.

3. The fabric care composition of claim 1 in which the thermoplastic elastomer is present in the composition in a solution, dispersion or emulsion.

4. The fabric care composition of claim 1, wherein the hard blocks comprise aromatic rings, optionally substituted.

5. The fabric care composition of claim 4, wherein the thermoplastic elastomer comprises hard blocks of polymers or copolymers of styrene or derivatives thereof.

6. The fabric care composition of claim 1, wherein the thermoplastic elastomer comprises soft blocks of polymers or copolymers of branched or unbranched, $C_2$ to $C_6$ alkenes, $C_4$ to $C_8$ alkadienes, $C_2$ to $C_6$ alkylene diols or $C_2$ to $C_8$ alkylene oxides.

7. The fabric care composition of claim 6, wherein the soft blocks are polymers or copolymers of ethene, propene, butane or butadiene.

8. A process for treating fabric which comprises coating the fabric with the composition of claim 1.

9. The process of claim 8 in which the fabric is ironed or dried, after application of the composition to the fabric.

10. The process of claim 8 wherein the fabric is treated with the composition during the rinse cycle.

11. A process for treating fabric which comprises contacting the fabric with a composition according to claim 1 wherein the treatment improves the crease recovery properties and/or elasticity and/or tensile strength of the fabric.

12. The fabric care composition of claim 1 which is an ABA block copolymer.

* * * * *